US006371833B1

(12) United States Patent
Huckels et al.

(10) Patent No.: US 6,371,833 B1
(45) Date of Patent: Apr. 16, 2002

(54) BACKING FILM FOR CHEMICAL MECHANICAL PLANARIZATION (CMP) OF A SEMICONDUCTOR WAFER

(75) Inventors: Kai Huckels, Poughkeepsie, NY (US); Klaus Herlitz, Dresden (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/438,305

(22) Filed: Sep. 13, 1999

(51) Int. Cl.[7] ..... B24B 1/00

(52) U.S. Cl. ..... 451/41; 451/60; 451/285; 451/286; 451/287

(58) Field of Search ..... 451/41, 60, 285, 451/286, 287

(56) References Cited

U.S. PATENT DOCUMENTS

| | | | | |
|---|---|---|---|---|
| 5,302,233 A | | 4/1994 | Kim et al. | |
| 5,486,129 A | | 1/1996 | Sandhu et al. | |
| 5,514,245 A | | 5/1996 | Doan et al. | |
| 5,885,135 A | * | 3/1999 | Desorcie et al. | 451/41 |
| 6,171,513 B1 | * | 1/2001 | Davis et al. | 216/88 |

* cited by examiner

*Primary Examiner*—Joseph J. Hail, III
*Assistant Examiner*—Shantese McDonald

(57) ABSTRACT

A backing film having areas of different compressibilities is useful in polishing semiconductor wafers.

28 Claims, 4 Drawing Sheets

BACKING FILM FOR CHEMICAL MECHANICAL PLANARIZATION (CMP) OF A SEMICONDUCTOR WAFER

BACKGROUND

1. Technical Field

This disclosure relates to semiconductor manufacture and more particularly to a novel backing film for chemical mechanical planarization of semiconductor wafers.

2. Background of Related Art

In the fabrication of integrated circuits, it is often necessary to polish a side of a part such as a thin flat wafer of a semiconductor material. In general, a semiconductor wafer can be polished to provide a planarized surface to remove topography or surface defects such as a crystal lattice damage, scratches, roughness, or embedded particles such as dirt or dust. This polishing process is often referred to as mechanical planarization or chemical mechanical planarization ("CMP") and is utilized to improve the quality and reliability of semiconductor devices. The CMP process is usually performed during the formation of various devices and integrated circuits on the wafer.

In general, the chemical mechanical planarization process involves holding a thin flat wafer of semiconductor material against a rotating wetted polishing surface under a controlled downward pressure. A polishing slurry such as a solution of alumina or silica may be utilized as the abrasive medium. A rotating polishing head or wafer carrier is typically utilized to hold the wafer under controlled pressure against a rotating polishing platen. A backing film is normally positioned between the wafer carrier and the wafer. The polishing platen is typically covered with a relatively soft wetted pad material such as blown polyurethane.

A particular problem encountered in the chemical mechanical planarization process is known in the art as the "loading effect". When the wafer is pressed against a relatively soft polishing pad on the polishing platen of the chemical mechanical planarization apparatus, the polishing pad may deform into the area between the structures to be removed, especially when the polishing rate of the structures is different then the polishing rate of the areas between the structures. This may cause an irregular or wavy surface to be formed on the wafer. In general, this phenomena occurs on the micro level and has an adverse affect on the integrated circuits formed on the wafer, especially in high density applications.

Another example of the loading effect is experienced when a protective or insulating layer of a dielectric material such as, for example, borophosphorus silicate glass, is deposited over transistors formed on a substrate. An initial conformal deposition of the protective layer may produce an irregular surface with peaks directly above the transistors and valleys between the transistors. As before, the polishing pad may deform to accommodate the irregular surface of the protective or dielectric layer. The resultant polished surface may appear on the micro level as wavy or irregular.

The loading effect may function in other situations to remove the sides and base of features present on the surface of a wafer during chemical mechanical planarization. In addition, the loading effect may occur locally or globally across the surface of the wafer. This problem may be compounded by the velocity differential between the outer peripheral portions and the interior portions of the rotating semiconductor wafer. The faster moving peripheral portions of the semiconductor wafer may, for instance, experience a relatively larger rate of material removal than the relatively slower moving interior portions.

In view of the foregoing, there is a need in semiconductor manufacture for a chemical mechanical planarization process that overcomes the loading effect. Accordingly, it is an object of the present invention to provide a polishing pad or backing film for use in a process to eliminate the loading effect.

SUMMARY OF THE INVENTION

It has now been found that a backing film having areas of different compressibilities can be advantageously employed to reduce or eliminate problems of uneven rates of polishing that may be encountered when polishing semiconductor wafers. Specifically, the backing films described herein include a first portion having relatively high compressibility and a second portion having a relatively low compressibility. Methods of polishing semiconductor wafers using backing films having ares of different compressibilities are also described.

DETAILED DESCRIPTION OF THE PREFERRED EMBODIMENTS

Novel backing films useful for polishing semiconductor wafers are described herein. The backing films include at least one area of relatively high compressibility and at least one area of low compressibility. By providing a backing film with such a compressibility gradient, greater polishing uniformity can be achieved, particularly where the wafer includes structures formed from different materials.

The compressibility gradient can be imparted to the backing film in any number of ways. For example, where the backing film is made from a synthetic polymeric material, the characteristics or composition of the polymer can be varied in different areas of the backing film. Suitable synthetic polymeric materials include polyurethanes, nylons, polyolefins or polyesters. Though less preferred, natural rubbers can be used in making one or more areas of the backing film.

In one aspect, the composition of the polymer can be varied such that one area of the backing film contains more of a rubbery component compared to other areas of the backing film. Those areas having a higher percentage of a rubbery component will have a higher compressibility than other ares having a lower amount of rubbery components. This approach to providing a compressibility gradient is particularly useful where a segmented, block or graft copolymer is used to form the backing film.

In another aspect, the crystallinity of the synthetic polymer can be varied in different areas of the backing film.

Areas of high crystallinity would exhibit lower compressibility, while areas of relatively low crystallinity (i.e., more amorphous areas) would exhibit higher compressibility. The relative crystallinity of different areas of the backing film can be controlled by techniques known to those skilled in the art. Such methods include, but are not limited to varying the degree of polymerization, adding various amounts of one or more comonomers, irradiating a portion of the backing film, annealing a portion of the backing film or combinations of these techniques.

Figure 1:
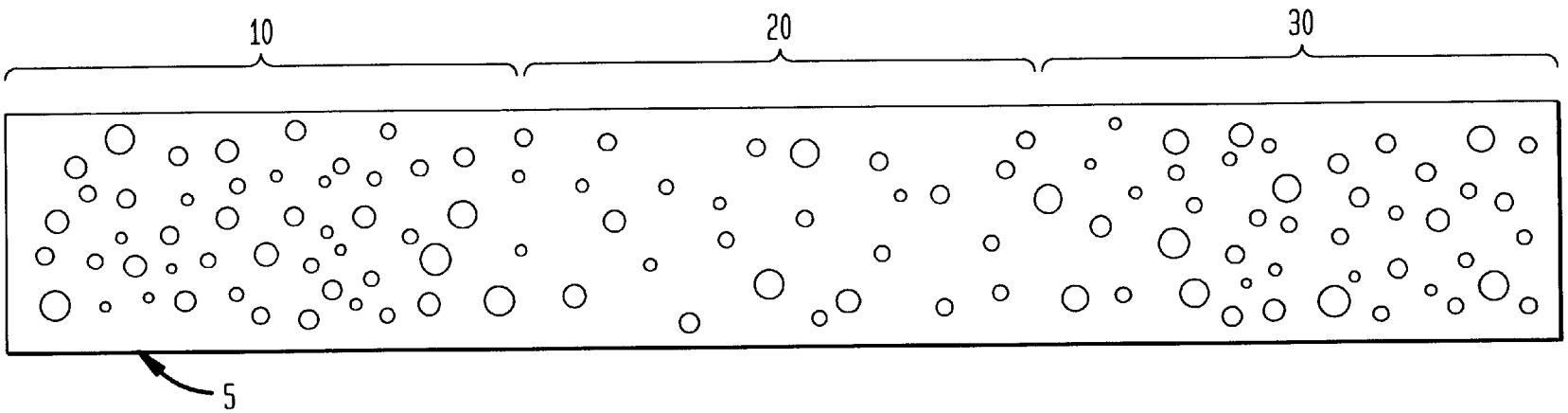
FIG. 1 shows a schematic cross-sectional view of an embodiment of a backing film in accordance with this disclosure.

It is further contemplated that the compressibility of different areas of the backing film can be adjusted by providing different degrees of porosity in different sections of the backing film. As seen in the embodiment shown in FIG. 1, for example, portion 10 of backing film 5 has a higher percentage of pores than portion 20 of backing film 5. The higher percentage of pores in portion 10 will make the pad more spongy in that area thereby providing a higher compressibility. In contrast, portion 20 of backing film 5 has a lower pore density and therefore exhibits lower compressibility. Portion 30 of backing film 5 again has a higher pore density and therefore is more compressible than adjacent portion 20. It is within the purview of those skilled in the art to provide a desired degree of porosity within a synthetic polymer body.

Figure 2:
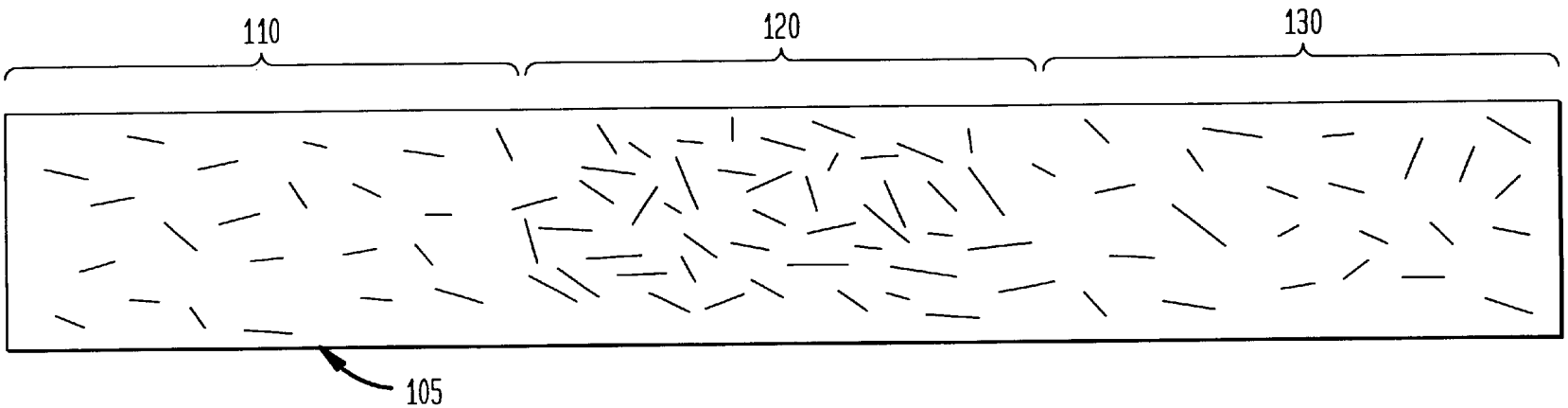
FIG. 2 shows a schematic cross-sectional view of another embodiment of a backing film in accordance with this disclosure.

In yet another aspect, a compressibility gradient can be established within the backing film by incorporating more of a particulate filler in a given area of the backing film and less filler in a different area. The particulate filler can be in any shape, such as, for example, granules, staple fibers, microspheres etc. While the composition of the particulate filler is not critical, preferably the filler is an inert material. Suitable fillers include alumina, silica, glass fibers, and glass microspheres. As seen in the embodiment shown in FIG. 2, portion 110 of backing film 105 has a lower amount of particulate filler than the amount of particulate filler in portion 120 of backing film 105. In this manner, portion 110 exhibits more compressibility than portion 120. Since portion 130 contains a lower amount of filler than is present in portion 120, portion 130 also has greater compressibility than portion 120. It should of course be understood that filler could be incorporated into only the portion(s) of the backing film which are to exhibit decreased compressibility, with no filler in other areas.

It is further contemplated that the backing film can be made from a felt having areas of higher and lower compressibility. As those skilled in the art will appreciate, felt is a nonwoven sheet of matted material made from fibers that are adhered by a combination of mechanical action, chemical action, pressure, moisture and/or heat. Areas of different compressibilities can be imparted to the felt backing film in any number of ways. For example, non-uniform processing conditions (e.g., locally higher heat or pressure) can be employed to provide denser, less compressible areas in the felt. As another example a particulate filler can be incorporated into desired areas of the felt to render those areas less compressible.

While the precise dimensions and characteristics of the backing film will depend on the type of polishing apparatus being employed and the type of device being polished, generally, the backing film will have a thickness of from about 0.01 inches to about 0.125 inches, preferably from about 0.03 inches to about 0.07 inches, most preferably from about 0.04 inches to about 0.06 inches. The static compressibility of the backing film will typically fall in the range of about 0.1 to about 10 percent, preferably in the range of about 0.3 to about 5 percent and most preferably in the range of about 0.5 to about 3.5 percent. In particularly useful embodiments, the high compressibility areas of the backing film will exhibit from about 2 to about 90 percent greater compressibility than the compressibility of the low compressibility areas, preferably from about 5 to about 50 percent greater compressibility.

The backing film can be any shape, but preferably is circular in shape. Any distribution of areas of relatively high compressibility and relatively low compressibility can be produced on the backing film. Once preferred distribution is a first circular area of low compressibility at the center of the backing film with an area of higher compressibility extending circumferentially outwardly from the first area. Another preferred distribution is a first circular area of high compressibility at the center of the backing film with an area of lower compressibility extending circumferentially outwardly from the first area. Other patterns for distribution of high and low compressibility areas will be apparent to those skilled in the art.

Figure 3:
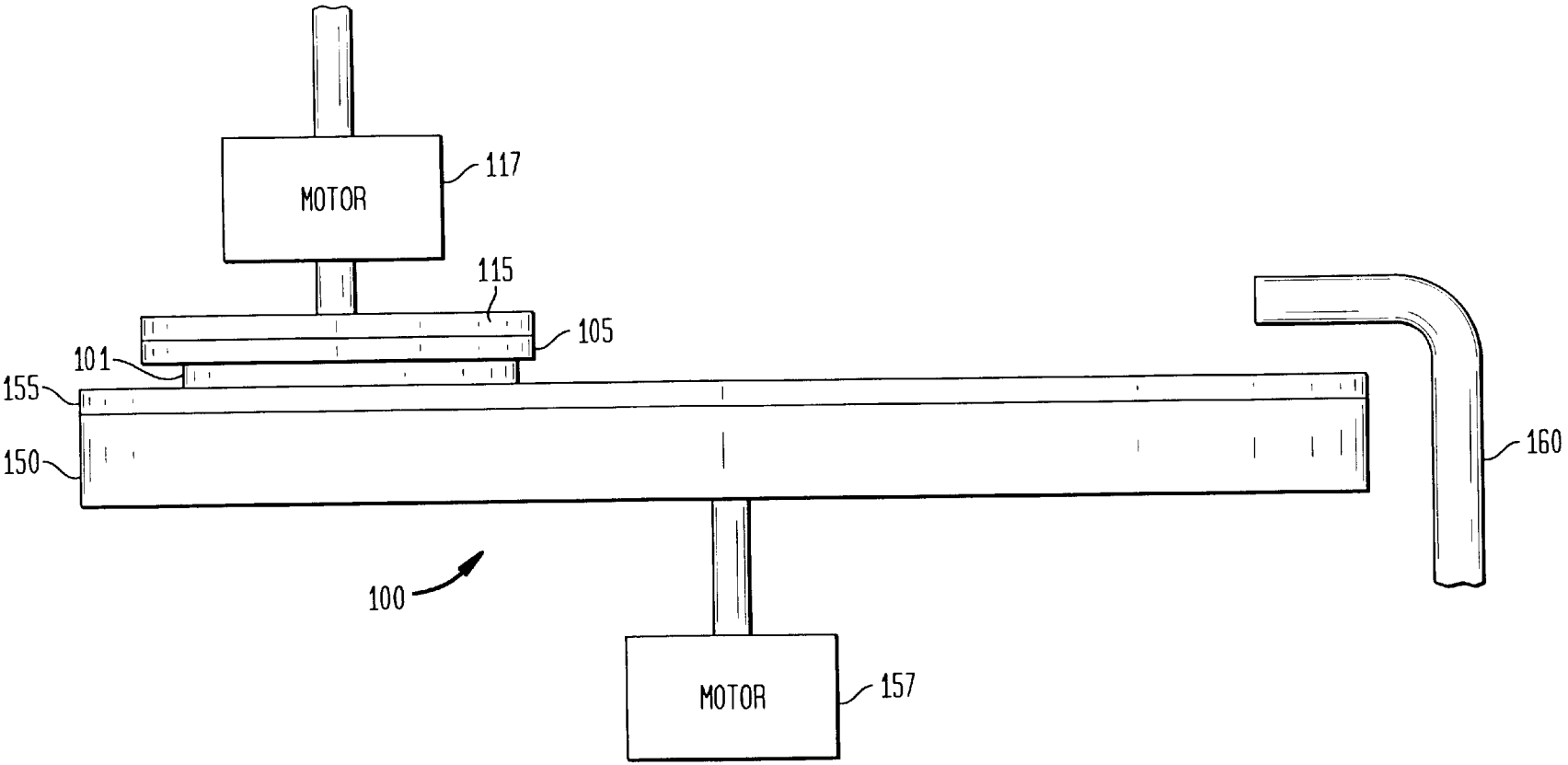
FIG. 3 shows a polishing apparatus in accordance with this disclosure.

As best seen in FIG. 3, polishing apparatus 100 includes a wafer carrier 115. A backing film 105 having a compressibility gradient is positioned between carrier 115 and wafer 101. Motor 117 can be used to rotate carrier 115. Polishing platen 150, which carries polishing pad 155, can be rotated by motor 157. A polishing slurry can be applied to polishing pad 155 via conduit 160.

Figure 4:
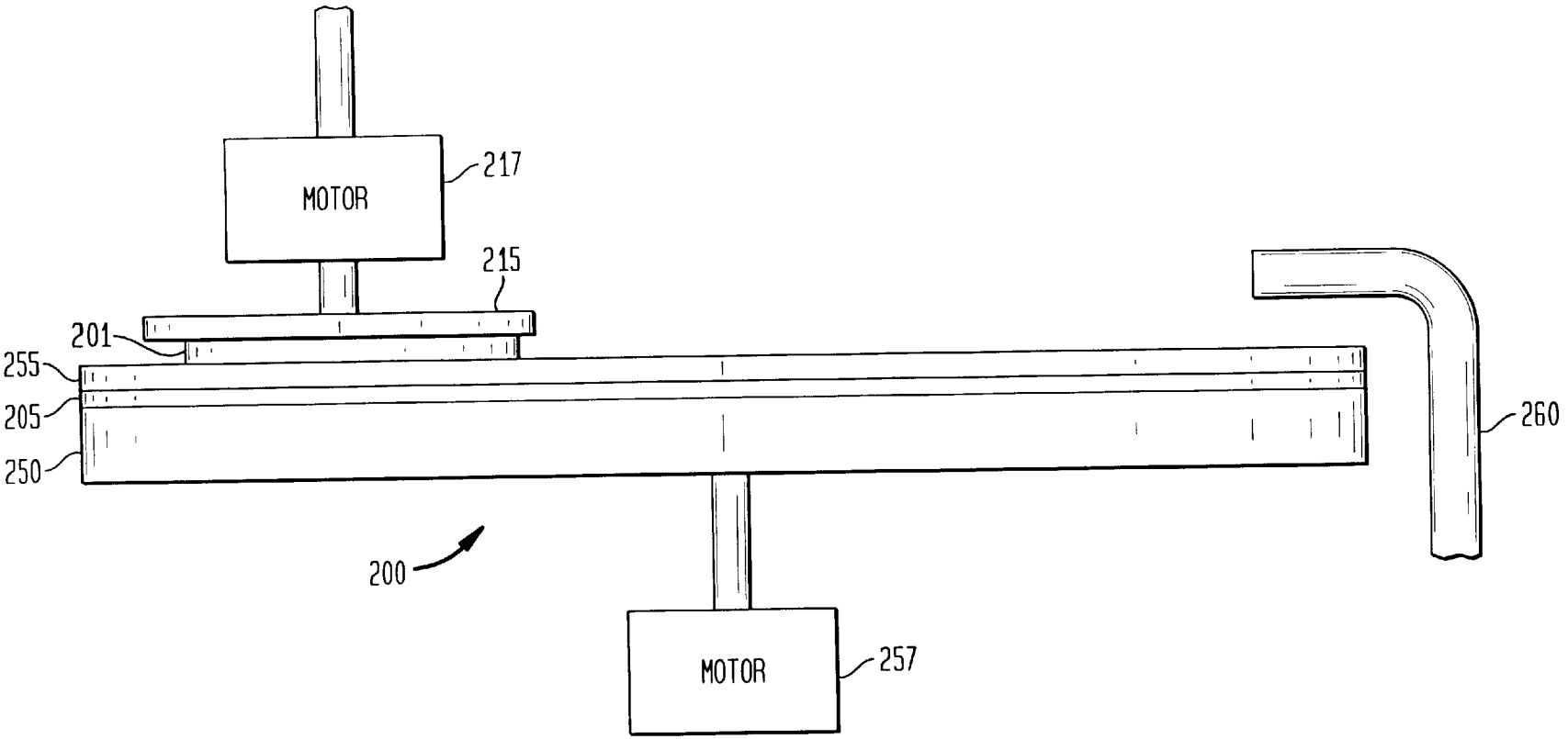
FIG. 4 shows an alternative embodiment of a polishing apparatus in accordance with this disclosure.

It is further contemplated that instead of employing a backing film exhibiting a compressibility gradient between the wafer carrier and the wafer, a backing film having variable compressibility can be employed between the polishing platen and a polishing pad having a homogenous compressibility. Such an embodiment is shown in FIG. 4, wherein polishing apparatus 200 includes a wafer carrier 215 for holding wafer 201. Motor 217 is used to rotate carrier 215. A backing film 205 having a compressibility gradient is positioned on polishing platen 250 and polishing pad 255 is positioned atop backing film 205. Motor 257 rotates platen 250. Conduit 260 supplies a polishing slurry onto pad 255.

Figure 5:
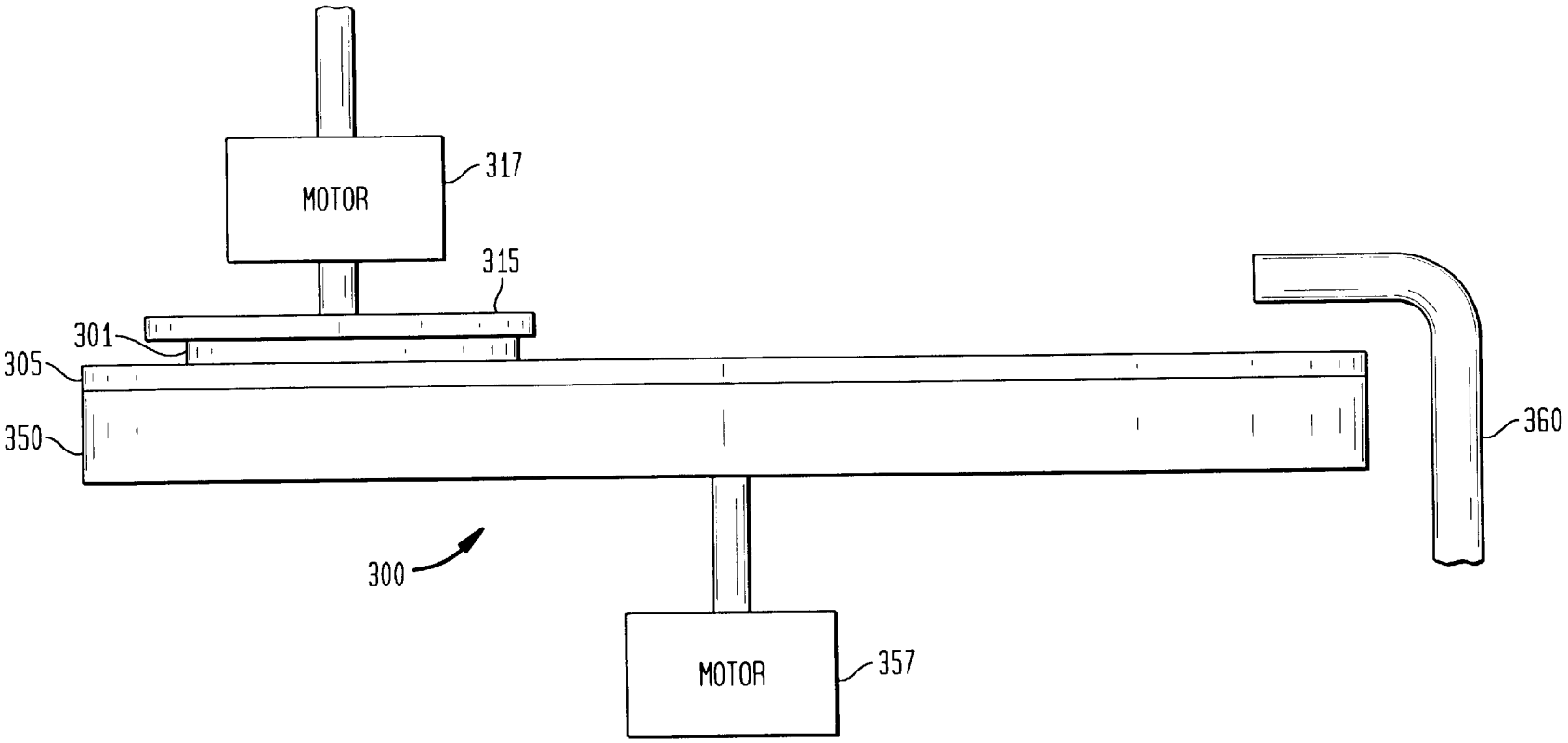
FIG. 5 shows yet another alternative embodiment of a polishing apparatus in accordance with this disclosure.

It is also contemplated that in an alternative embodiment a polishing pad having a compressibility gradient can be employed in the process. As best seen in FIG. 5, polishing apparatus 300 is used to contact wafer 301 with a polishing pad 305 having a compressibility gradient. Wafer 301 is held by wafer carrier 315 which can be rotated via motor 317. Polishing platen 350 supports polishing pad 305 and can be rotated by motor 357. Conduit 360 supplies polishing slurry to pad 355.

Although the present invention has been described in preferred forms with a certain degree of particularity, many changes and variations are possible therein and will be apparent to those skilled in the art after reading the foregoing description. It is therefore to be understood that the present invention may be practiced otherwise than as specifically described herein without departing from the spirit and scope thereof.

What is claimed is:

1. A backing film for polishing of a semiconductor wafer comprising:

a first portion having a first compressibility; and a second portion having a second compressibility, the first compressibility being greater than the second compressibility, wherein at least the second portion includes a particulate filler.

2. A backing film as in claim 1 wherein the first compressibility is from about 5 to about 50 percent greater than the second compressibility.

3. A backing film as in claim 1 wherein the first portion is circular in shape and the second portion is disposed circumferentially outwardly of the first portion.

4. A backing film as in claim 1 wherein the second portion is circular in shape and the first portion is disposed circumferentially outwardly of the second portion.

5. A backing film as in claim 1 wherein at least the first portion include pores.

6. A backing film as in claim 1 wherein the first compressibility is in the range of from about 0.3 to about 0.5%.

7. A backing film as in claim 1 wherein the second compressibility is in the range of from about 3.5 to about 10.0%.

8. A method of polishing a semiconductor wafer comprising:

holding a wafer within a wafer carrier with a backing film positioned intermediate the wafer and the wafer carrier, the backing film having a first portion exhibiting a first compressibility and a second portion exhibiting a second compressibility lower than the first compressibility, wherein at least the second portion includes a particulate filler; and contacting the wafer with a rotating polishing pad.

9. A method as in claim 8 wherein the first compressibility is from about 5 to about 50 percent greater than the second compressibility.

10. A method as in claim 8 wherein the first portion is circular in shape and the second portion is disposed circumferentially outwardly of the first portion.

11. A method as in claim 8 wherein the second portion is circular in shape and the first portion is disposed circumferentially outwardly of the second portion.

12. A method as in claim 8 wherein at least the first portion includes pores.

13. A method as in claim 8 further comprising applying a polishing slurry between the pad and the wafer.

14. An apparatus for polishing a semiconductor wafer comprising:

a wafer carrier adapted to hold a semiconductor wafer;

a backing film positioned between the wafer carrier and the wafer, the backing film having a first portion exhibiting a first compressibility and a second portion exhibiting a second compressibility lower than the first compressibility, wherein at least the second portion includes a particulate filler; and a rotating polishing pad positioned for contact with a wafer held by the wafer carrier.

15. An apparatus as in claim 14 wherein the first compressibility is from about 5 to about 50 percent greater than the second compressibility.

16. An apparatus as in claim 14 wherein the first portion is circular in shape and the second portion is disposed circumferentially outwardly of the first portion.

17. An apparatus as in claim 14 wherein at least the first portion include pores.

18. A chemical mechanical planarization apparatus comprising:

a platen;

a polishing pad; and a backing film between the platen and the polishing pad, the backing film having a first portion exhibiting a first compressibility and a second portion exhibiting a second compressibility lower than the first compressibility, wherein at least the second portion includes a particulate filler.

19. In an apparatus for polishing a semiconductor wafer including a wafer carrier adapted to hold the wafer in contact with a rotating polishing pad, the improvement comprising:

a backing film positioned between the wafer and the carrier, the backing film including a first portion having a first compressibility and a second portion having a second compressibility less than the first compressibility, wherein at least the second portion includes a particulate filler.

20. An apparatus as in claim 19 wherein the backing film is made from felt.

21. An apparatus as in claim 19 wherein the backing film is made from a porous synthetic polymer having a non-uniform pore distribution.

22. An apparatus as in claim 19 wherein the backing film is made from a synthetic polymer having a non-uniform distribution of filler therein.

23. A backing film for polishing of a semiconductor wafer comprising:

a first portion having a first compressibility; and a second portion having a second compressibility, the first compressibility being greater than the second compressibility, wherein the first portion is circular in shape and the second portion is disposed circumferentially outwardly of the first portion.

24. A method of polishing a semiconductor wafer comprising:

holding a wafer within a wafer carrier with a backing film positioned intermediate the wafer and the wafer carrier, the backing film having a first portion exhibiting a first compressibility and a second portion exhibiting a second compressibility lower than the first compressibility, wherein the first portion is circular in shape and the second portion is disposed circumferentially outwardly of the first portion; and contacting the wafer with a rotating polishing pad.

25. An apparatus for polishing a semiconductor wafer comprising:

a wafer carrier adapted to hold a semiconductor wafer;

a backing film positioned between the wafer carrier and the wafer, the backing film having a first portion exhibiting a first compressibility and a second portion exhibiting a second compressibility lower than the first compressibility, wherein the first portion is circular in shape and the second portion is disposed circumferentially outwardly of the first portion;

a rotating polishing pad positioned for contact with a wafer held by the wafer carrier.

26. A chemical mechanical planarization apparatus comprising:

a platen;

a polishing pad; and a backing film between the platen and the polishing pad, the backing film having a first portion exhibiting a first compressibility and a second portion exhibiting a second compressibility lower than the first compressibility, wherein the first portion is circular in shape and the second portion is disposed circumferentially outwardly of the first portion.

27. In an apparatus for polishing a semiconductor wafer including a wafer carrier adapted to hold the wafer in contact with a rotating polishing pad, the improvement comprising:

a backing film positioned between the wafer and the carrier, the backing film including a first portion having a first compressibility and a second portion having a second compressibility less than the first compressibility, wherein the first portion is circular in shape and the second portion is disposed circumferentially outwardly of the first portion.

28. A backing film for polishing of a semiconductor wafer comprising a base material, the base material including at least one of pores and filler material disposed within the based material to provide a compressibility gradient as a function of position on the backing film.

* * * * *